US006422312B1

(12) United States Patent
Delatorre et al.

(10) Patent No.: US 6,422,312 B1
(45) Date of Patent: Jul. 23, 2002

(54) MULTIZONE PRODUCTION MONITORING SYSTEM

(75) Inventors: Leroy C. Delatorre, Sugar Land; James Reaux, Brookshire; Arthur J. Morris, Magnolia; Ronald E. Pringle, Houston, all of TX (US)

(73) Assignees: Retrievable Information Systems, LLC; Schlumberger Technology Corporation, both of Sugar Land, TX (US)

( * ) Notice: Subject to any disclaimer, the term of this patent is extended or adjusted under 35 U.S.C. 154(b) by 0 days.

(21) Appl. No.: 09/417,487

(22) Filed: Oct. 13, 1999

Related U.S. Application Data

(63) Continuation-in-part of application No. 09/112,030, filed on Jul. 8, 1998, now Pat. No. 6,082,455.

(51) Int. Cl.[7] ..... E21B 47/01

(52) U.S. Cl. ..... 166/250.15; 166/66; 166/250.11; 166/242.5

(58) Field of Search ..... 166/250.15, 250.11, 166/117.5, 250.07, 65.1, 66, 242.5, 322

(56) References Cited

U.S. PATENT DOCUMENTS

| | | | | |
|---|---|---|---|---|
| 3,357,492 A | * | 12/1967 | Hubby | 166/106 |
| 4,173,754 A | | 11/1979 | Feiker | |
| 4,227,405 A | | 10/1980 | West | |
| 4,459,760 A | | 7/1984 | Watson et al. | |
| 4,524,831 A | * | 6/1985 | Pringle | 166/322 |
| 4,556,866 A | | 12/1985 | Gorecki | |
| 4,577,333 A | | 3/1986 | Lewis et al. | |
| 4,742,475 A | | 5/1988 | Kaiser et al. | |
| 5,452,344 A | | 9/1995 | Larson | |
| 5,491,468 A | | 2/1996 | Everett et al. | |
| 6,082,455 A | * | 7/2000 | Pringle et al. | 166/250.15 |

FOREIGN PATENT DOCUMENTS

| | | |
|---|---|---|
| WO | WO-98/48145 | * 10/1998 |

* cited by examiner

*Primary Examiner*—David Bagnell
*Assistant Examiner*—Zakiya Walker
(74) *Attorney, Agent, or Firm*—W. Allen Marcontell

(57) ABSTRACT

In a multiple well completion, spaced apart production packers isolate independent production zones from one another. In each isolated production zone, a side pocket mandrel with a full opening bore has lengthwise extending side by side elongated pockets (1) for receiving a static pressure measuring instrument or tool (static pressure pocket); (2) for providing a venturi flow passageway (flow passageway pocket); and (3) for receiving a differential pressure measuring tool (differential pressure pocket). The static pressure measuring tool and the differential pressure measuring tool or instrument are commonly connected by a data coupling means to a single electrical conductor line which is strapped to the string of tubing and extends to the earth's surface for transmission of control signals and data signals between the earth's surface and the various side pocket tools. The venturi flow passageway is connected for fluid communication with the static pressure pocket and the differential pressure pocket in the side pocket mandrel. Fluid flow from a particular production zone is channeled through the respective venturi flow passageway to the full opening bore and the fluid flow parameters are communicated to the static pressure measuring tool and to the differential pressure tool. The flow passageway is constructed and arranged to develop a differential pressure which is measured by the differential pressure measuring tool. At the same time, the static pressure of the production fluid in the production zone is measured by the static pressure measuring tool. Both the differential pressure measurements and the static pressure measurements may be transmitted to the surface and recorded as a function of real time.

17 Claims, 5 Drawing Sheets

MULTIZONE PRODUCTION MONITORING SYSTEM

CROSS-REFERENCE TO RELATED APPLICATION

The present application is a Continuation-In-Part of prior application Ser. No. 09/112,030 filed Jul. 8, 1998 and now U.S. Pat. No. 6,082,455.

FIELD OF THE INVENTION

This invention relates to systems for multiple completions where more than one producing zone is traversed by a well bore and production can be obtained from more than one production zone into a common string of tubing. More particularly, this invention has to do with a system for monitoring the quantity of production from independent production zones by independently measuring the differential pressure and the static pressure in a production zone on a real time basis while providing a full opening bore for production and remedial operations of lower zones.

BACKGROUND OF THE INVENTION

Heretofore, there has been a problem with multiple completions in that regulatory agencies can require the operator to produce from only one single production zone at a time in a multiple zone well so that the production quantity for each zone can be independently ascertained. While this occurs, the other production zones cannot be produced and are, in fact, shut off. In multilateral completions (earth surface or underwater), it is also common to connect lateral pipes in a given production zone to a zone of production so that multiple zone productions are obtained and it is of vital interest to monitor the production flow from each zone.

The system heretofore principally utilized uses multiple packers in a well casing where the packers separate production zones. A string of production tubing extends through the well packers and a side pocket mandrel is located in a section of the tubing string between a pair of production packers. The side pocket mandrel is utilized in the control of fluid flow which enters the tubing string through the bottom of the side pocket mandrel. One method of control is simply to block the passage so that fluid flow is stopped and fluid is produced from a selected side pocket and the fluid flow is measured at the earth's surface. In any event, it is not possible to ascertain what fluid flow occurs with any degree of preciseness and production is typically limited to one zone at a time.

SUMMARY OF THE PRESENT INVENTION

In the present invention, in a multiple completed well, spaced apart production packers are provided to isolate independent production zones from one another. In each of the isolated production zones, a side pocket mandrel is provided with a full opening bore, i.e. a bore which does not restrict the passage of well tools. The side pocket mandrel has lengthwise extending side by side elongated pockets (1) for receiving a static pressure measuring instrument or tool (static pressure pocket); (2) for providing an elongated pressure differential flow passageway (flow passageway pocket); and (3) for receiving a differential pressure measuring tool (differential pressure pocket). The static pressure measuring tool and the differential pressure measuring tool or instrument are commonly connected by a data coupling means to a single electrical conductor line which is strapped to the string of tubing and extends to the earth's surface for transmission of control signals and data between the earth's surface and the various side pocket tools. The differential flow passageway is connected for fluid communication with the static pressure pocket and the differential pressure pocket in the side pocket mandrel. Fluid flow in the production zone is channelled through the flow passageway to the full opening bore and the fluid is communicated to the static pressure measuring tool and to the differential pressure tool. The flow passageway is constructed and arranged to develop a differential pressure which is measured by the differential pressure measuring tool and which can be stored in a memory of the tool. At the same time, the static pressure of the production fluid in the production zone is measured by the static pressure measuring tool. Both the differential pressure measurements and the static pressure measurements can be recorded in a memory as a function of real time.

When a electrical polling signal is generated at the earth's surface to a specific side pocket mandrel, the static pressure and the differential pressure of the production fluid are read out at the surface as real time data by transmission to the earth's surface on the conductor cable.

A real time reference can also be generated in the well tools and initiated when the tools are installed for use with a memory. With retrievable tools, both the static pressure tool and the differential pressure tool can be independently retrieved at any time and the memories can then be read out independently at the earth's surface should the conductor line fail to function for one reason or another.

With the present system, the static pressure and differential pressure of fluid flow from each production zone is independently measured at the time of production and sequentially and repetitively read out at the earth's surface. From the pressure measurements and flow equations, the production flow is determined. With the equipment arrangement, a full bore opening is also provided so that any remedial operations or the like can be conducted on lower zones without requiring removal of any other devices in full opening bore.

DESCRIPTION OF THE INVENTION

Figure 1:
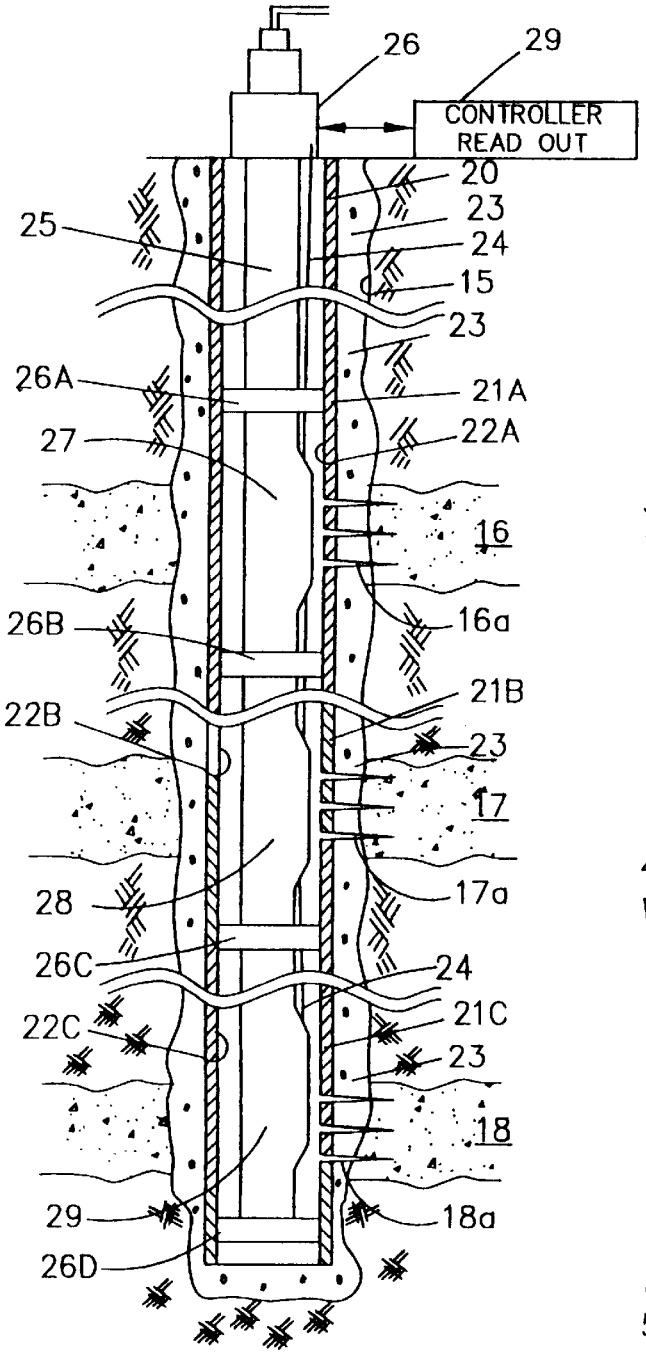
FIG. 1 is a schematic representation of a well bore traversing earth formations where multiple zones produce hydrocarbons into a common string of tubing and where the static and dynamic pressure of the production flow for each zone is measured and communicated to the earth's surface.

Referring now to FIG. 1, a well bore 15 is illustrated as traversing earth formations which include production zones 16, 17, and 18. While the illustration is relative to earth formations, it is the same principal with respect to underwater completions where as platform or the like serves as an earth surface and underwater production zones are connected by lateral pipes to independent production zones along a well pipe or casing.

In an well bore as illustrated, there is typically a surface casing 20 and one or more well liners 21(A–C) where the casing and liners are cemented in place by an annulus of cement 23. Perforations 16*a*, 17*a* and 18*a* typically place the hydrocarbons in the earth formations in fluid communication with the bores 22(A–C) of the liner sections 21(A–C). A string of tubing 25 extends from a well head 26 and extends through production packers 26(A–D) which isolate the production zones between adjacent packers in the liners. Disposed in each of the production zones between spaced apart packers and connected in the string of tubing is a side pocket mandrel 27,28, and 29 where each side pocket mandrel has a full opening bore which provides an uninterrupted continuation of the bore of the tubing string. Fluid flow from the respective production zones enters the liner sections and passes through the lengthwise extending side pockets of the side pocket mandrels. The side pocket mandrels have flow passageways communicating the annulus in the casing with the tubing string. Also at the earth's surface is a controller-read out means 29 which is connected by a single electrical conductor 24 to each of the downhole side pocket mandrels. The controller-read out means 29 provides a polling signal to each of the side pocket mandrels through data transmission techniques and reads out independent static pressure and differential pressure of fluid flow through a side pocket mandrel.

Figure 2:
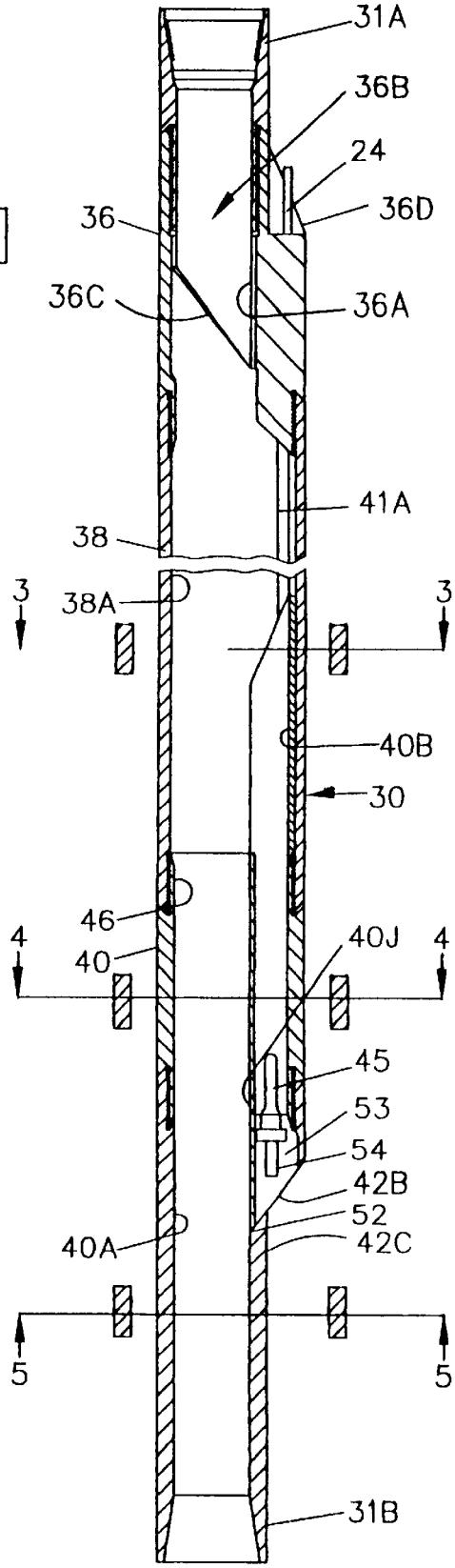
FIG. 2 is view in longitudinal cross-section illustrating the general construction configuration for a side pocket mandrel in which the present invention is embodied.

Referring now to FIG. 2, an overall construction configuration of the side pocket mandrel is as follows: the side pocket mandrel 30 as illustrated is interconnected between adjacent tubing pup joints or sections 31A and 31B of a string of tubing or production tubing so as to form a part of the string of tubing.

The side pocket mandrel 30 is generally an elongated cylindrically shaped member formed by four sections or parts comprising, from top to bottom, respectively, an upper takeout housing part 36, a body pipe part 38, a side pocket housing part 40, and a lower housing part 42. Each mandrel part 36, 38, 40 respectively have aligned full opening bores 36A, 38A, and 40A, which are equal or larger than the bore of the production tubing 25. The full opening bores extend through the length of mandrel 30 so that the mandrel 30 has an effective full opening bore. The effective full opening bore permits wireline side pocket well tools and other small diameter tools to pass through mandrel 30 to locations below and in the mandrel 30.

Figure 3:
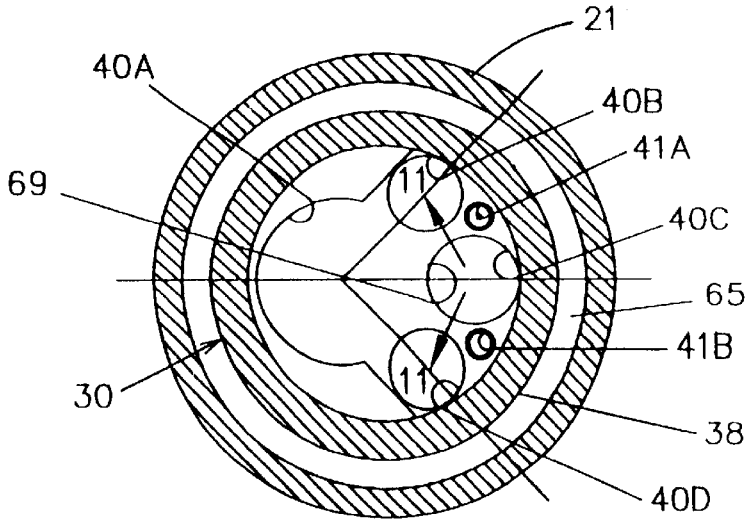
FIG. 3 is a view in cross-section taken along line 3—3 of FIG. 2 with editing for clarity of presentation.
Figure 4:
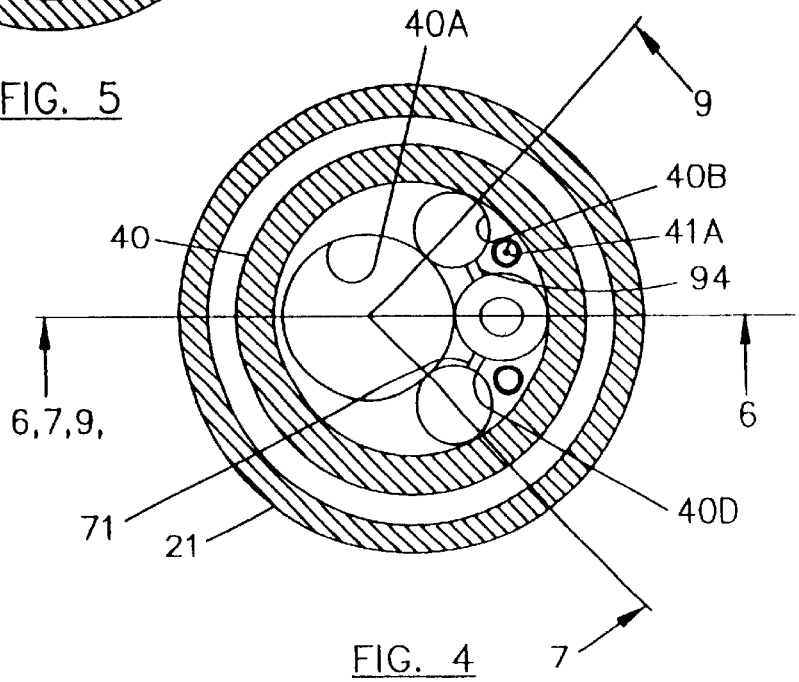
FIG. 4 is a view in cross-section taken along line 4—4 of FIG. 2 with editing for clarity of presentation.

In the side pocket housing part 40, there are three side by side bores 40B, 40C, and 40D which are generally parallel to and laterally offset from the full opening bore 40A (see FIGS. 3 and 4). A side pocket bore 40B as illustrated in FIG. 2 is sized to receive a static pressure tool.

Extending lengthwise through the housing part 40 and offset from the side pocket bores 40B,40C and 40D and the full opening bore 40A is a conduit or pipe 41A which is sized to pass an electrical conductor therethrough. As shown in FIGS. 3 and 4, a second, blank conduit or pipe 41B located on the other side of pocket bore 40C can be provided for a guide pipe, if desired.

At the lower end of the side pocket bore 40B are fluid bypass ports which are openings in a wall surface which place the bores 40A and 40D in fluid communication so that a static pressure well tool can be received in the static pressure pocket 40B. Also disposed in the lower end of the pocket 40B is an inductive coupling probe member 45. The coupling member 45 is sealingly attached to the lower end of the pocket 40B. The coupling member 45 cooperates with a socket coupling member on a well tool for the transmission of data between a well tool and an electrical conductor 24 which passes through in the conduit 41A and out the upper end of the side pocket mandrel.

The electrical conductor 24 attached to the inductive coupling member 45 can be connected through a "Y" coupling so that the conductor 24 also extends downwardly to another well tool.

Again referring to FIG. 2, the upper body part 38 is a tubular member with an internal bore and an enlarged lower bore at its lower end. The lower end of the part 38 is coupled to the housing part 40. When assembled, the bore 38A receives the upper cut away portion 46 of the housing part 40.

The take out housing part 36 has a central portion with an enlarged bore which receives a tubular deflector 36B. The tubular deflector 36B has guide means 36C which guide a kickover tool for orientation relative to an offset pocket bore. The upper end of the part 36 has an offset internally threaded bore for threadedly receiving the tubing sub 31A. The tubing sub 31A engages the deflector 36B which is locked in rotative position by a locking key. In the open space between downwardly facing shoulder on the part 36 and the upper surface of the part 40, the tubular pipe member 41A extends longitudinally between the bore in the part 40 and a bore 41B in the part 36. The pipe member 41A protects and encloses the electrical conductor 24 with respect to the open space.

Figure 5:
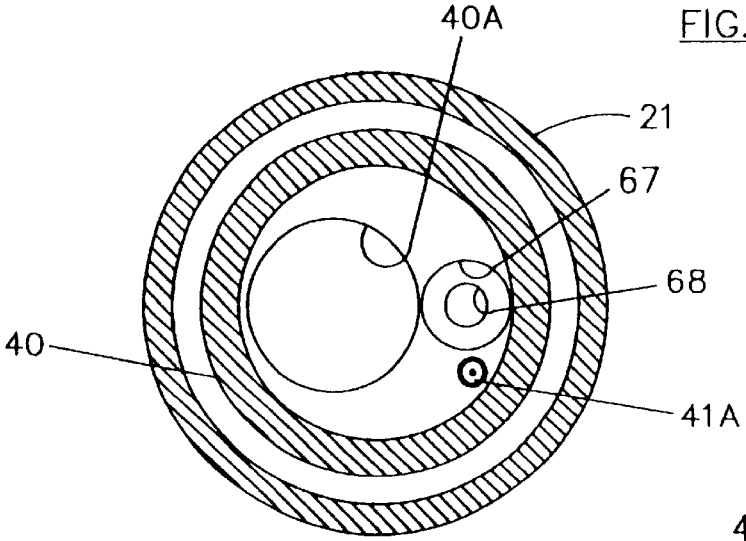
FIG. 5 is a view in cross-section taken along line 5—5 of FIG. 2 with editing for clarity of presentation.
Figure 6:
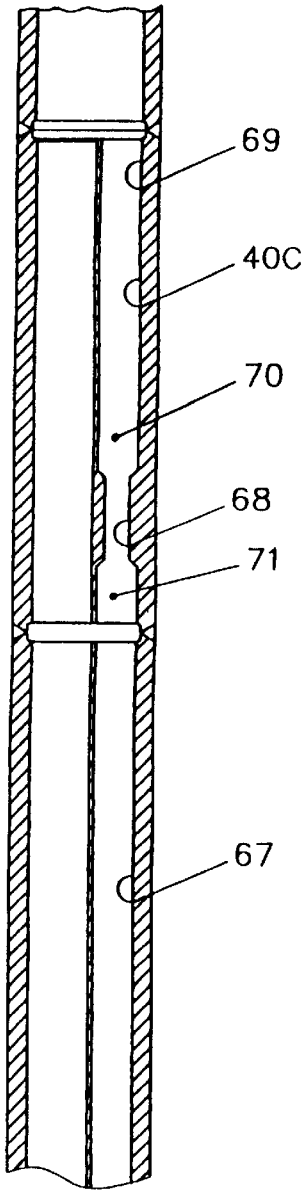
FIG. 6 is a view in cross-section taken along line 6—6 of FIG. 4 with editing for clarity of presentation to illustrate the flow passageway pocket.
Figure 8:
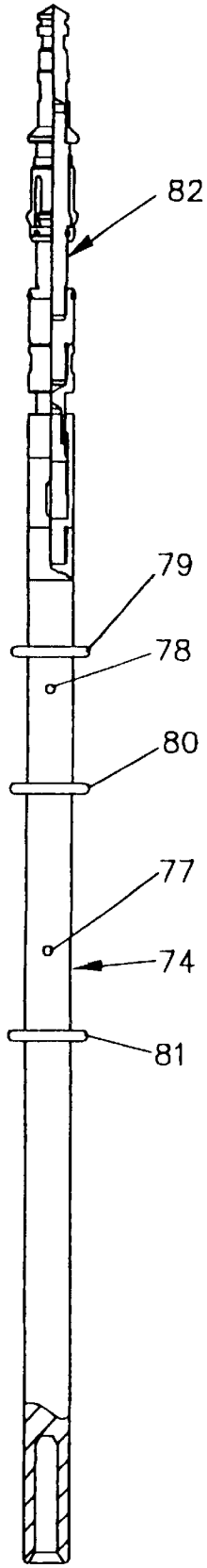
FIG. 8 is a view of a differential pressure well tool in relation to the differential pressure pocket shown in FIG. 7.

Referring now to FIGS. 3, 4, and 5, in a typical casing section 22A, an open annulus 65 between the casing section 22A and the exterior of a typical side pocket mandrel 30 contains the flow of hydrocarbons from a production zone. A central flow passageway pocket 40C is in communication with the open annulus 65 by virtue of a lower passageway 67 which opens to the bottom end of the side pocket mandrel (see FIGS. 6 and 11). Intermediate of the length of the pocket 40C is a venturi bore 68 which opens to an upper passageway 69. Fluid flow from the annulus (and the production zone) is thus directed through the flow passageway pocket 40C to the full open bore of the tubing string. As the fluid flows through the venturi bore, a pressure drop occurs and there is a pressure differential between fluid in the passageway 67 upwardly of the venturi bore and fluid in the passageway 69 downwardly of the venture bore. Transverse communication passageways 70 and 71 are located above and below the venturi bore and are in fluid communication with a differential pressure measuring tool 74 (see FIG. 8) which develops communication signal data as a function of the differential pressure of the fluid flow in the flow passageway pocket 40C.

Figure 11:
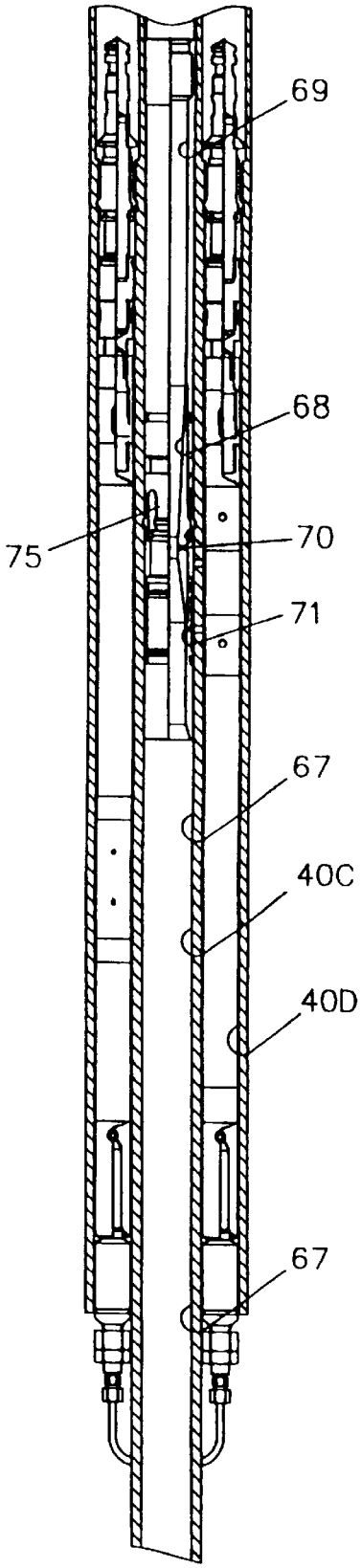
FIG. 11 is a plan view of the three pockets taken along an arc 11—11 of FIG. 3.

In FIG. 11, a design is illustrated wherein the flow passageway pocket 40C receives a retrievable venturi assembly 75 which can be removed from the side pocket 40C with a removal and insertion tool 96 (FIG. 12) which will be discussed hereafter. In any event, the upstream and downstream pressure differential communication passageways 71, 70 are coupled for fluid communication to the differential pressure pocket bore 40D which contains a differential pressure measuring tool 74.

Figure 7:
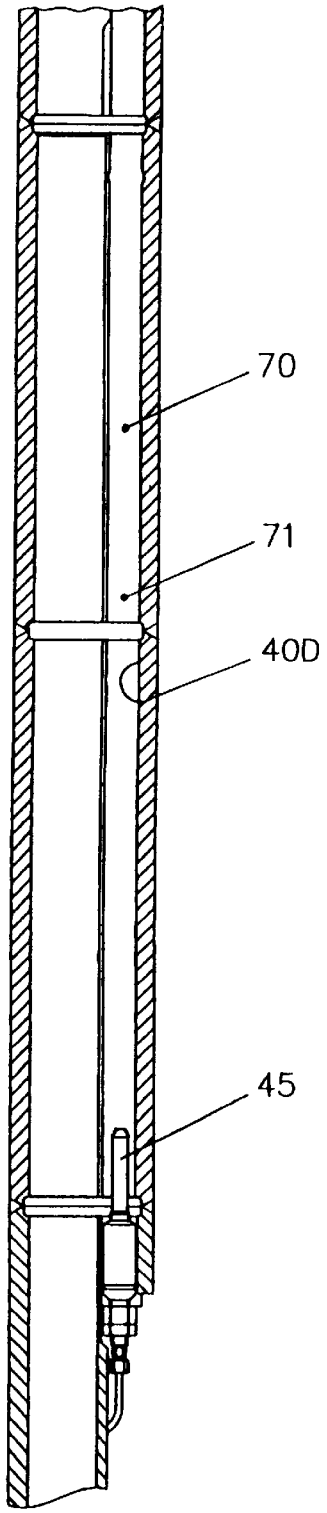
FIG. 7 is a view in cross-section taken along line 7—7 of FIG. 4 with editing for clarity of presentation to illustrate the differential pressure pocket.

As illustrated in FIG. 7, the differential pressure pocket 40D is constructed generally as illustrated in FIG. 2 with an inductive coupling probe member 45 at its lower end and is, constructed and arranged to releasably receive a differential pressure measuring tool 74. The tool 74 is sized and adapted to be retrievably located within the differential pressure pocket 40D. The differential pressure tool 74 has spaced apart ports 77 and 78 which are located between spaced apart seals 79, 80, 81 so that when the tool is in the pocket 40D, the port 77 of the tool 74 is communication with the communication passageway 71 and the port 78 is in communication with the passageway 70. Thus, pressure of the fluid above and below the Venturi bore are supplied to the tool 74. In response to sensing of the pressures, the tool develops a data transmission code representative of the differential pressure sensed in the flow passageway pocket 40C. The tool 74 includes a retrieving and latching head assembly 82 which functions with a placement tool (see FIG. 12) to be disposed or removed from the side pocket 40D. When the tool 74 is in the pocket 40D it is latched in position and the data is developed in an electronic means within the tool and available for transmission to the electrical conductor 24 via the coupling member 45. while not necessary, the tool 74 can also include a memory section with a clock means where the data can be stored as a function of real time in the tool and read out independently after being retrieved.

Figure 9:
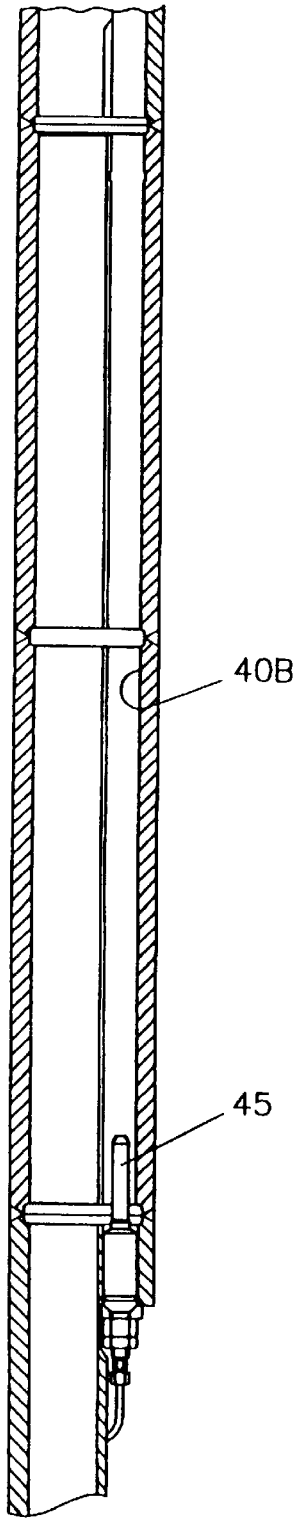
FIG. 9 is a view in cross-section taken along line 9—9 of FIG. 4 with editing for clarity of presentation to illustrate the static pressure pocket.
Figure 10:
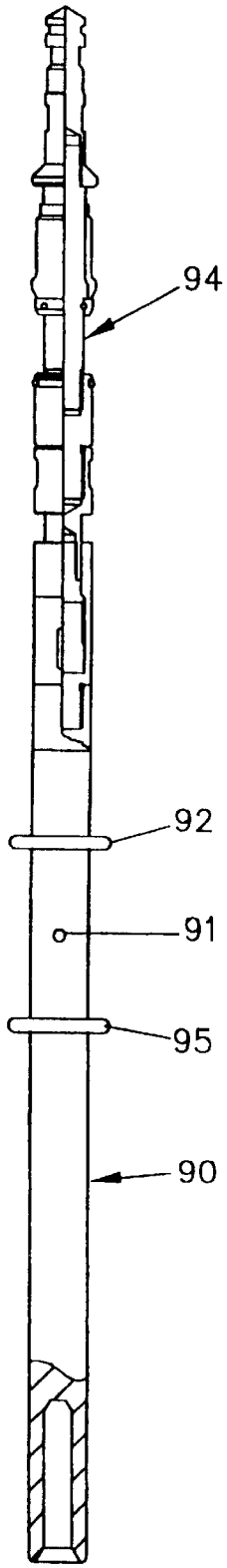
FIG. 10 is a view of a static pressure well tool in relation a static pressure pocket shown in FIG. 9.

As illustrated in FIG. 9, the static pressure pocket 40B is constructed generally as illustrated in FIG. 2 with an inductive coupling probe member 45 at it's lower end and a static pressure measuring tool 90 is sized and adapted to be retrievably located within the static pressure pocket 40B. The static pressure tool 90 has pressure sensing ports 91 which are located between spaced apart seals 92 and 93 so that when the tool 90 is in the pocket 40B. the ports 91 of the tool are in communication with a communication passageway 94 to the flow passageway pocket (see FIG. 4). Thus, static pressure is supplied to the tool 90 which develops a data transmission code representative of the static pressure sensed in the flow passageway 40C. The tool 90 includes a retrieving and latching head assembly 94 which functions with a placement tool (see FIG. 12) to be disposed or removed from the side pocket 40B. When the tool 90 is in the static pressure pocket it is latched in position and the data is developed in an electronic means within the static pressure tool and available for transmission to the electrical conductor 24 via the coupling member 45. while not necessary, the tool can also include a memory section with a clock means where the data can be stored as a function of real time in the tool and read out independently after being retrieved.

Figure 12:
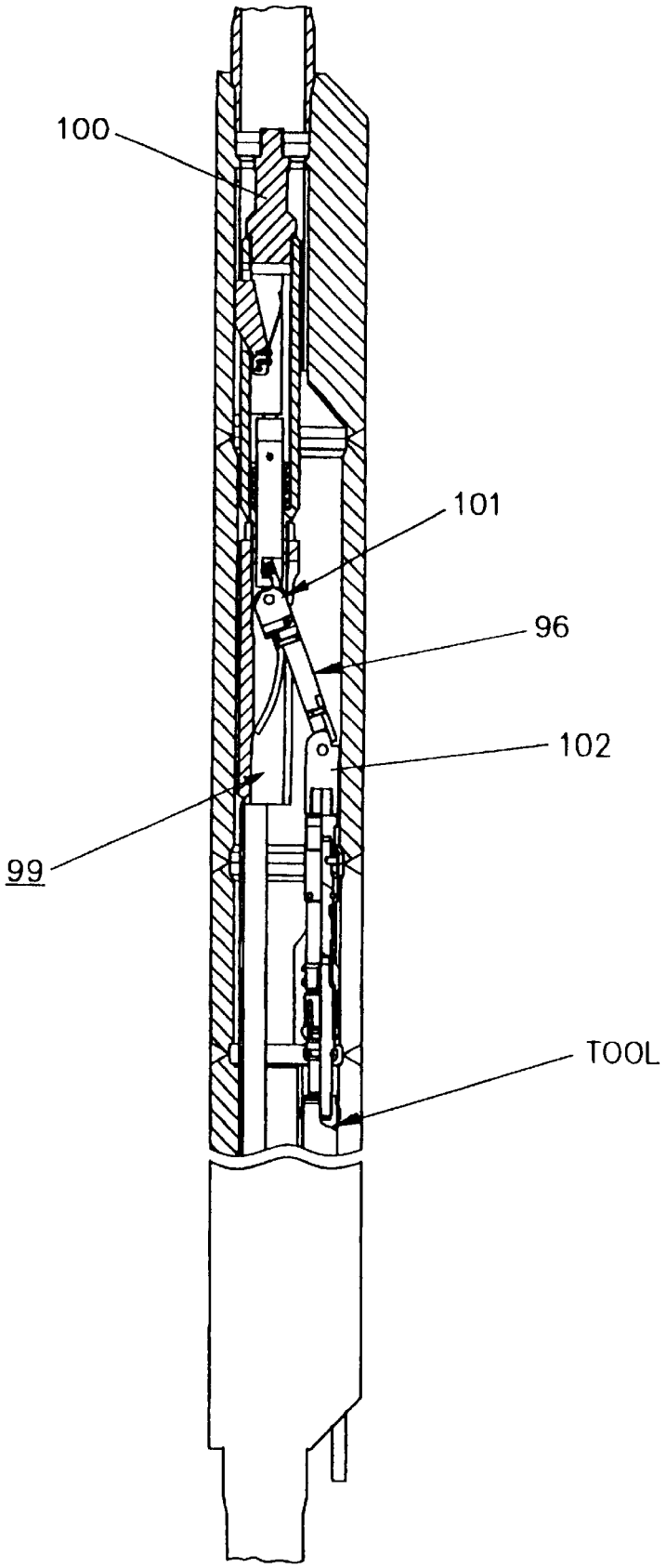
FIG. 12 is a schematic illustration of a kick over tool for use with the present invention.

Referring now to FIG. 12, a placement and retrieving tool 96 is illustrated and includes an elongated housing 99 attached to a release housing 100. An articulated linkage mechanism 101 is connected to a pulling or retrieving tool 102 for disposition or removal of a tool or member from a side pocket bore.

In operation, the production packers 26(A–D), the string of tubing 25, the side pocket mandrels 27,28,29, as desired and the electrical conductor 24 are installed so that there is an electrical communication conductor connection to all of the side pocket mandrels and to the controller-read out means 29 at the earth's surface or operating platform.

In each of the side pocket mandrels utilizing the present invention there are three side pocket bores which are offset from a full opening bore where the full opening bore is in alignment with the full opening of the tubing string. The three side pocket bores respectively define: a fluid flow pocket 40C; a static pressure pocket 40B; and a differential pressure pocket 40D. The fluid flow pocket 40C opens to the bottom of a side pocket mandrel and is in direct communication with the full opening bore of a side pocket mandrel so that production flow is through the fluid flow passageway pocket to the string of tubing. Disposed within the fluid flow pocket 40C is a Venturi means 68 which develops a differential pressure of the fluid between upstream and downstream fluid flow. The fluid flow pocket 40C has a transverse passageway 94 coupling the static pressure in the fluid flow pocket 40C to the static pressure pocket 40B. Disposed in the static pressure pocket 40B is a static pressure measuring tool 90 which is releasably latched in the static pressure bore and has an inductive coupling means cooperating with an inductive coupler 45 in the static pressure pocket 40B. The static pressure measuring tool 90 develops a data signal as a function of static pressure.

The differential pressure measuring pocket 40D has separate passageways 70, 71 to the upstream and downstream pressure developed by the Venturi means 68. A differential pressure measuring tool 74 is retrievably disposed within the differential pressure pocket 40D with seal means and senses the upstream and downstream pressure and develops a data signal as a function of the differential pressure in the fluid flow pocket 40C. The differential pressure measuring tool 74 has and inductive coupling means cooperating with an inductive coupler 45 in the differential pressure pocket 40D. The various tools can be installed and removed as desired. While not illustrated, as it is conventional, the various side pockets can be mechanically coded with respect to the installation and retrieving tool so that the section of tool can be more precisely controlled.

At the platform or earth's surface, the controller read out means 29 sends a data polling signal to the respective static pressure tool and the differential pressure tool in each side pocket and sequentially and repetitively reads out the current differential pressure and static pressure from each side pocket as the transmission occurs at the platform or earth's surface. From the differential pressure and the static pressure read out, the fluid flow can be calculated from standard flow equations. Thus, each the production zones can be simultaneously produced into the string of tubing and the production from each production zone is determinable. Hence, there is no need to shut down one or more production zones to determine the production flow from any given zone. At the same time the full opening bore permits operations at any time at any location without requiring removal of any obstructions in the string of tubing.

The differential pressure measuring tool, the static measuring tool, the controller-read out means, running and kick over tools are available from Panex Corporation at Sugar Land, Texas and/or are also disclosed in various prior patent applications and patents.

It will be apparent to those skilled in the art that various changes may be made in the invention without departing from the spirit and scope thereof and therefore the invention is not limited by that which is disclosed in the drawings and specifications but only as indicated in the appended claims.

What is claimed is:

1. For use in a well containing more than one production zone where the production zones are isolated from one another and where the production zones are produced into a common production tubing, a side pocket mandrel comprising:

an elongated body member constructed for connection in a string of tubing and having a full opening bore and having side by side laterally offset elongated side pocket bores;

at least one of said side pocket bores, herein called static pressure pocket, being constructed and arranged to receive a static pressure measuring tool;

at least one of said side pocket bores, herein called fluid flow pocket, being constructed and arranged to provide a fluid flow passageway and means in said fluid flow pocket for developing a differential pressure from fluid flow through said fluid flow pocket;

at least one of said side pocket bores, herein called pressure differential pressure pocket, being constructed and arranged to receive a differential pressure measuring tool;

first passage means coupling said fluid flow pocket to said differential pressure pocket for enabling the measurement of differential pressure; and second passage means coupling said fluid flow pocket to said static pressure pocket for enabling the measurement of static pressure.

2. The apparatus as set forth in claim 1 wherein at least one of said static pressure pocket and said differential pressure pockets includes an inductive coupler means attached to an electrical conductor which can be extended to a surface location for communication between the surface and a tool located in one of said pockets.

3. The apparatus as set forth in claim 1 wherein each of said static pressure pocket and said differential pressure pockets includes an inductive coupler means attached to an electrical conductor which can be extended to a surface location for communication between the surface and a tool located in one of said pockets.

4. The apparatus as set forth in claim 1 wherein said means for developing a pressure differential includes a venturi bore and said first passage means connects to said fluid flow pocket at locations above and below said venturi bore.

5. The apparatus as set forth in claim 1 wherein the first passage means includes a retrievable venturi bore element in said fluid flow pocket.

6. In a well containing more than one production zone where the production zones are isolated from one another and where the production zones are produced into a common production tubing, a side pocket mandrel system comprising:

at least one elongated side pocket mandrel having a body member constructed and connected in a string of tubing for at least one production zone, said side pocket mandrel having a full opening bore and having side by side, laterally offset, elongated side pocket bores;

at least one of said side pocket bores, herein called static pressure pocket, being constructed and arranged to receive a static pressure measuring tool;

at least one of said side pocket bores, herein called fluid flow pocket, being constructed and arranged to provide a fluid flow passageway and means in said fluid flow pocket for developing a differential pressure from fluid flow through said fluid flow pocket;

at least one of said side pocket bores, herein called pressure differential pressure pocket, being constructed and arranged to receive a differential pressure measuring tool;

first passage means coupling said fluid flow pocket to said differential pressure pocket for enabling the measurement of differential pressure; and second passage means coupling said fluid flow pocket to said static pressure pocket for enabling the measurement of static pressure.

7. The apparatus as set forth in claim 6 wherein at least one of said static pressure pocket and said differential pressure pockets includes an inductive coupler means attached to an electrical conductor which can be extended to a surface location for communication between the surface and a tool located in one of said pockets.

8. The apparatus as set forth in claim 6 wherein each of said static pressure pocket and said differential pressure pockets includes an inductive coupler means attached to an electrical conductor which can be extended to a surface location for communication between the surface and a tool located in one of said pockets.

9. The apparatus as set forth in claim 6 wherein said means for developing a pressure differential includes a venturi bore element and said first passage means connects to said fluid flow pocket at locations above and below said venturi bore.

10. The apparatus as set forth in claim 6 wherein a side pocket mandrel is located in at least two production zones wherein at least one of said static pressure pocket and said differential pressure pockets in each tool includes an inductive coupler means attached to a common electrical conductor which can be extended to a surface location for communication between the surface and a tool located in one of said pockets.

11. A method for monitoring well production in a well containing more than one production zone where the production zones are isolated from one another and where the production zones are produced into a common production tubing, said method comprising:

disposing a side pocket mandrel on a string of tubing in at least one production zone where the side pocket mandrel has an elongated body member and has a full opening bore and has side by side, laterally offset, elongated side pocket bores and where at least one of said side pocket bores, herein called static pressure pocket, is constructed and arranged to receive a static pressure measuring tool, and where at least one of said sidepocket bores, herein called fluid flow pocket, is constructed and arranged to provide a fluid flow passageway and means are located in said fluid flow pocket for developing a differential pressure from fluid flow through said fluid flow pocket, and wherein at least one of said side pocket bores, herein called pressure differential pressure pocket, is constructed and arranged to receive a differential pressure measuring tool, and wherein first passage means couples said fluid flow pocket to said differential pressure pocket for enabling the measurement of differential pressure and second passage means couples said fluid flow pocket to said static pressure pocket for enabling the measurement of static pressure; and, disposing a static pressure measuring tool in said static pressure pocket and a differential pressure measuring tool in said differential pressure pocket.

12. The method as set forth in claim 11 and further including the step of:

establishing a communication coupling between at least one of said tools and a surface location for communication between the tool and the surface location.

13. The method as set forth in claim 11 wherein at least one of said static pressure pocket and said differential pressure pockets includes an inductive coupler means attached to an electrical conductor which is extended to a surface location for communication between the surface and a data measuring tool located in one of said pockets and the further step of retrievably locating said data measuring tool in said side pocket mandrel.

14. The method as set forth in claim 13 wherein each of said static pressure pocket and said differential pressure pockets includes an inductive coupler means attached to an electrical conductor which is extended to a surface location for communication between the surface and a data measuring tool located in one of said pockets and the further step of retrievably locating a static pressure measurement tool in said static pressure pocket and locating a differential pressure measurement tool in said differential pressure pocket.

15. The method as set forth in claim 11 and further including the step of disposing a side pocket mandrel in at least two production zones in a well bore where the side pocket mandrels each have an elongated body member and have a full opening bore and have side by side, laterally offset, elongated side pocket bores and where, in each side pocket mandrel, at least one of said side pocket bores, herein called static pressure pocket, is constructed and arranged to receive a static pressure measuring tool, and where at least one of said side pocket bores, herein called fluid flow pocket, is constructed and arranged to provide a fluid flow passageway and means are located in said fluid flow pocket for developing a differential pressure from fluid flow through said fluid flow pocket, and wherein at least one of said side pocket bores, herein called pressure differential pressure pocket, is constructed and arranged to receive a differential pressure measuring tool, and wherein first passage means couples said fluid flow pocket to said differential pressure pocket for enabling the measurement of differential pressure and second passage means couples said fluid flow pocket to said static pressure pocket for enabling the measurement of static pressure; and, disposing a static pressure measuring tool in each of said static pressure pockets and a differential pressure measuring tool in said differential pressure pockets.

16. The method as set forth in claim 15 and further including the step of:

establishing a communication coupling between at least one of said tools in each of said side pocket mandrels and a surface location for communication between the tool and the surface location.

17. The method as set forth in claim 16 wherein at least one of said static pressure pocket and said differential pressure pockets includes an inductive coupler means attached to a common electrical conductor which is extended to a surface location for communication between the surface and a tool located in one of said pockets and the further step of retrievably locating at least one of said tools in a side pocket mandrel.

* * * * *